US008486847B2

(12) United States Patent
Fan et al.

(10) Patent No.: US 8,486,847 B2
(45) Date of Patent: Jul. 16, 2013

(54) FABRIC SIMULATING THE PLANT STRUCTURE FOR MOISTURE MANAGEMENT

(75) Inventors: Jintu Fan, Hong Kong (CN); Yu-cheung Szeto, Hong Kong (CN); Manas Kumar Sarkar, Hong Kong (CN)

(73) Assignee: The Hong Kong Polytechnic University, Kowloon (CN)

( * ) Notice: Subject to any disclaimer, the term of this patent is extended or adjusted under 35 U.S.C. 154(b) by 1809 days.

(21) Appl. No.: 11/684,452

(22) Filed: Mar. 9, 2007

(65) Prior Publication Data

US 2008/0220185 A1 Sep. 11, 2008

(51) Int. Cl.
*D03D 15/00* (2006.01)

(52) U.S. Cl.
USPC ..... 442/205; 442/206; 442/207; 442/239; 442/304

(58) Field of Classification Search
USPC ..... 442/239, 205–207, 304
See application file for complete search history.

(56) References Cited

U.S. PATENT DOCUMENTS

| | | | | |
|---|---|---|---|---|
| 5,217,782 | A | 6/1993 | Moretz et al. | |
| 6,432,504 | B1 | 8/2002 | Yeh | |
| 6,509,285 | B1 * | 1/2003 | Yeh | 442/195 |
| 2001/0044249 | A1 * | 11/2001 | Demott et al. | 442/304 |

FOREIGN PATENT DOCUMENTS

DE 19851688 A1 * 5/2000

* cited by examiner

*Primary Examiner* — Elizabeth Cole
(74) *Attorney, Agent, or Firm* — Foley & Lardner LLP

(57) ABSTRACT

A fabric having moisture management function, which has a structure simulating plant structure and comprises at least two layers as follows: a bottom layer, which is of a leno or matt structure simulating main stem of plant, in which a number of yarns are grouped together to form a plurality of fabric units; said bottom layer can be adapted to be in contact with human skin; a top layer, which is of a plain weave structure, in which the yarns of said fabric unit further split in the top layer to form such a plain weave structure, simulating the branching in plant structure; wherein, in said fabric, water can be transported from the bottom layer to the middle layer and further to the top layer where it evaporates due to the improved capillarity of the yarns so as to provide better moisture management function.

19 Claims, 4 Drawing Sheets

FABRIC SIMULATING THE PLANT STRUCTURE FOR MOISTURE MANAGEMENT

FIELD OF THE INVENTION

The present invention relates to articles and fabrics, in particular, fabrics having a textile construction simulating structures of plants, and which possess excellent moisture management function, as well as methods of making fabrics and articles, and methods of using articles and fabrics.

BACKGROUND OF THE INVENTION

With the improvement in living standards, our requirements for clothing are not only on the basic warm-keeping function of the clothing but also on the wearing comfort. Although conventional clothes made of pure cotton tend to have better sweat absorption properties, they tend to retain the sweat in the fabric layer next to the skin, giving wearer an uncomfortable feeling of wet and cold after exercise. It thus becomes an objective of the field to develop a type of fabric which possesses excellent moisture management function.

U.S. Pat. No. 5,217,782 discloses a multi-layer fabric having moisture management function which comprises a thicker inner layer composed of hydrophobic fiber having good water permeability; a thinner middle hydrophilic layer and a thicker outer hydrophilic layer. Due to the hydrophobic nature of the inner layer, water can be transported to outer layer very quickly without having to stay in the inner layer and thereby brings a better feeling to wearers. This invention has a disadvantage in that, unless the garment is tightly fitted to the body and sweat is transmitted through the inner hydrophobic layer, the sweat will stay on or drip down along the skin surface, as the hydrophobic inner layer does not absorb liquid sweat, U.S. Pat. No. 6,432,504 discloses a composite fabric having moisture management function. It transports water on skin to outer layer through the capillary action and this composite fabric comprises an inner hydrophilic layer formed of a thicker fiber and an outer hydrophilic layer formed of a thinner fiber. However, by having fibers of different fineness in the inner and outer layer, the liquid transport function of this fabric is very much limited.

Although the fabrics disclosed in the above-mentioned two patent documents possess certain level of moisture management function, their liquid water transport property is very much limited.

SUMMARY OF THE INVENTION

An object of the present invention is to provide a fabric having excellent water transport properties for moisture management, so as to keep the wearer cool and dry. Also provided are related methods of making, methods of using, articles, and articles derived therefrom.

In one embodiment, the present invention provides a fabric having moisture management function, which has a structure simulating plant structure and comprises at least two layers as follows: (i) a bottom layer, which may be of a leno or matt structure simulating main stem of plant, in which a number of yarns are grouped together to form a plurality of fabric units; wherein said bottom layer can be adapted to be in contact with human skin; (ii) a top layer, which may be of a plain weave structure, in which the yarns of said fabric units in the bottom layer split in the top layer to form such a plain weave structure. Each group of multiple yarns from the bottom layer is split into single yarns in the top layer, which simulates the branching in the structure of plant.

In another embodiment, the present invention provides a fabric having three layers: (i) a bottom layer, which may be of a leno or matt structure simulating main stem of plant, in which a number of yarns are grouped together to form a plurality of fabric units; wherein said bottom layer can be adapted to be in contact with human skin; (ii) a middle layer, which may be of a matt, huckaback or honeycomb structure simulating branches of plant, in which the yarns of said fabric unit split initially in the middle layer to form such a matt, huckaback or honeycomb structure; (iii) a top layer, which may be of a plain weave structure, in which the yarns of said fabric unit further split in the top layer to form such a plain weave structure. The splitting of groups of yarns into smaller groups of yarns in the middle layer and into single yarns in the top layer simulates the branching in the structure of the plant.; wherein, in said fabric, water can be transported from the bottom layer to the top layer or from the bottom layer to the middle layer and further to the top layer where it evaporates faster due to the spread of liquid water on the top surface so as to provide better moisture management function.

In the fabric having the structure according to the present invention, because of its emulation of such plant structures in its textile construction, water can be effectively transported so as to greatly improve water transport property of the fabric.

The present invention will be further described according to its preferred embodiment with reference to attached drawings.

BRIEF DESCRIPTION OF THE DRAWINGS

FIG. 7(*b*) is a graph showing the absorption behavior of the fabric having the two-layer Plant Structure (Coolmax Weft);

FIG. 9(*b*) is a diagram of a matt weave.

FIG. 9(*c*) is a diagram of a leno weave.

FIG. 9(*d*) is a diagram of a huckaback weave.

FIG. 9(*e*) is a diagram of a honeycomb weave.

DETAILED DESCRIPTION OF PREFERRED EMBODIMENTS

Plants are nature's creation for covering the earth; they not only possess the most important process for sustaining life on earth, i.e. the photosynthesis, but also provide necessary protection over the earth and have excellent water transport properties. Through this special structure of plants, underground water can be transported against the gravity from the roots all the way up to leaves of plants. Studies have shown that the excellent water transport properties of plants attribute to the special structural features that exist in plants. The greater ratio of surface area to volume in the leaves than that in the stems of plants forms a special tree-shaped network, which favors water transport. The tree-shaped networks also exist in many other natural flow systems in nature such as river basins, human lungs, blood vessels and the like. This fact also proves that this tree-shaped network has the advantage in water transport of this tree-shaped network.

The present invention utilizes emulation of such plant structure in a textile construction, i.e. to form a substantially tree-shaped network in textile construction so as to achieve an excellent water transport property. The unique material has excellent water transport and thermal properties. Such material will be ideal for clothing as it would facilitate the transport of sweat and water from skin so as to keep the wearer dry and comfortable. It also has other applications, such as carpet, a manmade grass, geotextiles (i.e. a fabric used for civil construction) and etc. for its benefits in keeping the under-covered area dry.

Figure 1:
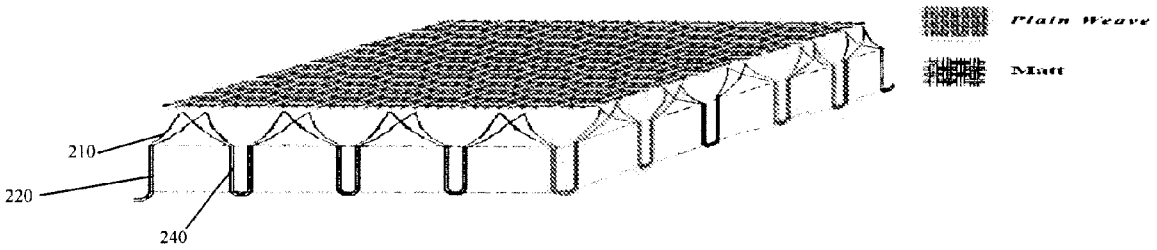
FIG. 1 is a schematic structural view of a two-layer fabric according to the first embodiment of the invention.

FIG. 1 is a schematic structural view of a two-layer fabric according to the first embodiment of the invention.

As shown in FIG. 1, the fabric according to the first embodiment of the present invention is a woven fabric having two layers; the bottom layer 220 in contact with skin is a matt structure, in which two yarns are grouped together to form a plurality of stem-like fabric units 240, which are respectively arranged in rows. The fabric unit 240, i.e. the "two-yarn stems" splits into single yarns in the top layer 210, which is a plain weave structure. The splitting simulates the branching in the structure of the plant, which creates a greater surface area to volume ratio.

Figure 2:
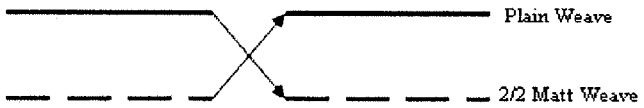
FIG. 2 is to schematically show the interchanging of warp and weft of the fabric according to the first embodiment of the invention.

A method for preparing the two-layers fabric according to the first embodiment of the present invention is as follows:

In the two layers fabric as shown in FIG. 2, both warp and weft yarns in the bottom and top layer interchanges. As the two yarn groups move from the bottom layer to the top layer, they split into single yarns.

Figure 3:
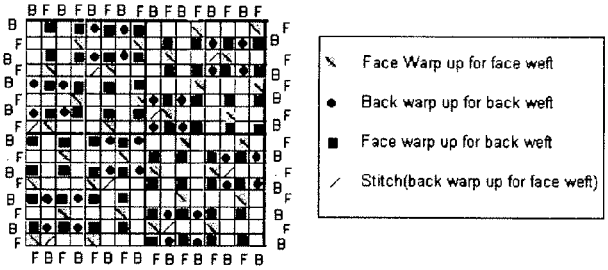
FIG. 3 is to schematically show the weave design of the fabric according to the first embodiment of the invention.

The weave designs of the two layers fabric is depicted in FIG. 3. The weave design is well within the limit of dobby loom with 16 heald shafts.

Figure 4:
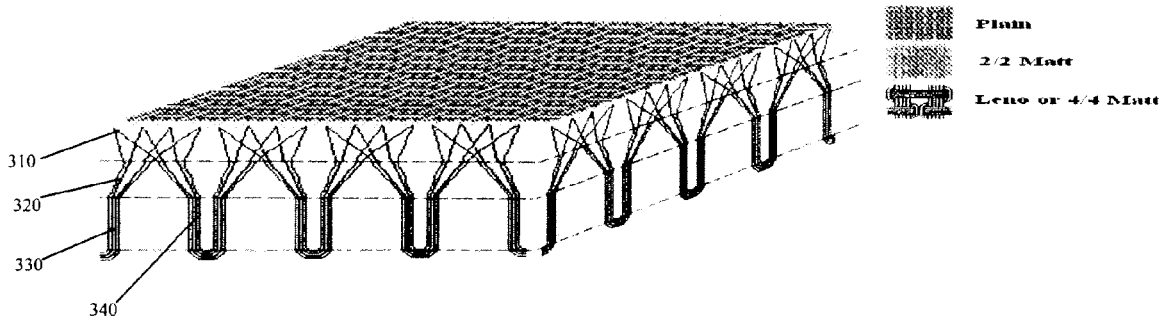
FIG. 4 is a schematic structural view of a three-layer fabric according to the second embodiment of the invention.

As shown in FIG. 4, the fabric according to the second embodiment of the present invention is a woven fabric having three layers; the bottom layer 330 in contact with skin is a 4×4 matt structure, in which four or more yarns are grouped together to form a plurality of stem-like fabric units 340, which are respectively arranged in rows. The fabric unit 340, i.e. the "four-yarn stem" split into "two-yarn branches" in the middle layer 320 locating above the bottom layer 330, which then form a 2×2 matt structure simulating the branching in the structure of plant. The top layer 310 locating above the middle layer 320 is a plain weave structure, in which said yarns separate at the top layer 310 so as to obtain a greater surface area to volume ratio.

Figure 5:
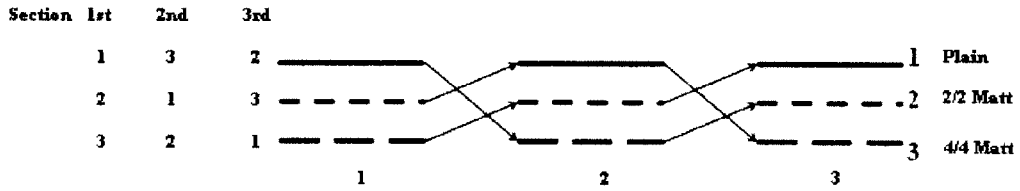
FIG. 5 is to schematically show interchanging of weft of the fabric according to the second embodiment of the invention.

A method for producing the three layers fabric according to the second embodiment of the present invention is as follows:

In the three layers fabric, as shown in FIG. 5, the weft yarns interchanged from the bottom layer to the middle layer and finally to the top layer, thereafter return from the top layer to the bottom layer.

Figure 6:
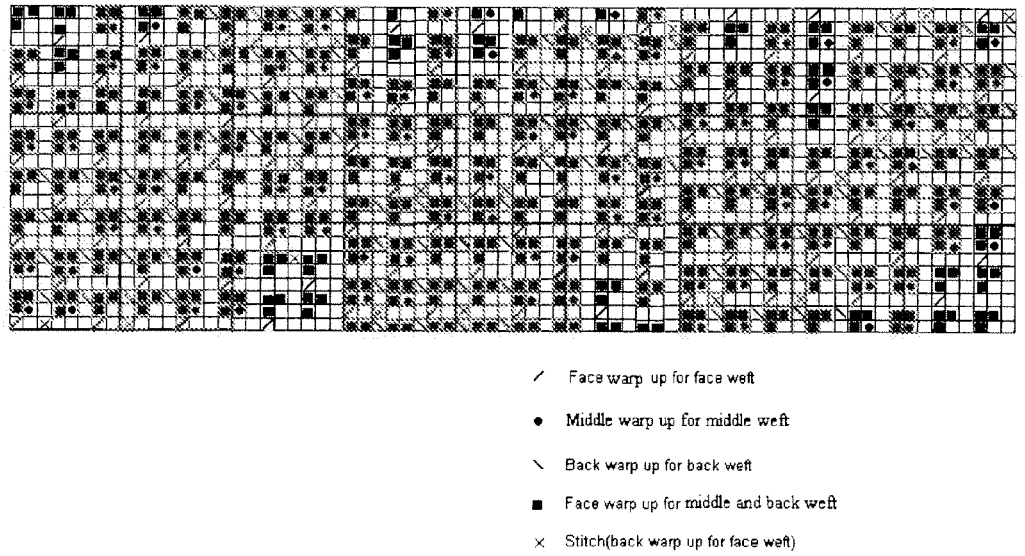
FIG. 6 is to schematically show the weave design of the fabric according to the second embodiment of the invention.

The weave designs of the three layers fabric is depicted in FIG. 6. The weave design is well within the limit of dobby loom with 24 heald shafts. The three layers fabric depicted by FIG. 4 only has interchanging stitches in the weft. It is also possible to produce the three layer fabric with interchanging stitches in both warp and weft direction for the three layer fabrics, but for that a jacquard weaving machine is required to weave the fabric, as designs will exceed the capacity of a normal dobby loom. For both the two-layer and three-layer fabrics, the upper surface of the top layer may be further finished to create hairiness and/or loops to simulate the leaf of a plant. Moreover, the roots may be simulated by having a finish of brushing pile on the lower surface of the bottom layer to enhance water transport property.

Physical and chemical treatment may be also applied to a fiber, yarn and fabric. For example, hydrophilic treatments including oxygen plasma or oxidation may be applied to the bottom surface to enhance water absorption. Compared with existing moisture management fabrics, the treated fabric facilitates liquid water transport (or wicking) by the combination of different fibers and yarns. The new clothing material has the advantage of enhancing wicking due to improved capillarity and the cohesion-tension mechanism owing to its tree-shaped network. The large spaces between the "stems" in the bottom layer of the fabric will also facilitate air convection or ventilation next to the skin.

Figure 9A:
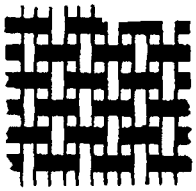
FIG. 9(*a*) is a diagram of a plain weave.
Figure 9B:
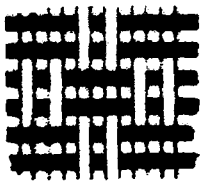
Figure 9C:
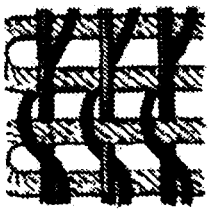
Figure 9D:
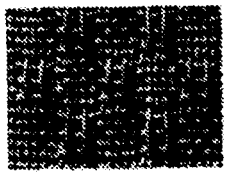
Figure 9E:
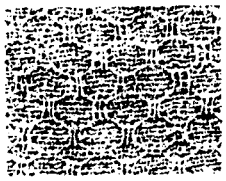

The "plain, matt, leno, huckaback and honeycomb" weave structures, mentioned above are technical terms defined as follows:

| Weave type | Description | Diagram |
|---|---|---|
| Plain | A style of weave, in which the weft and warp yarns intertwine alternately, to produce a checkerboard effect. In this weave, each yarn gives maximum amount of support to the adjacent yarn, and in proportion to the quantity of materials employed. | FIG. 9(a) |
| Matt | A variation of the plain weave in which two or more warp and filling yarns are woven side by side to resemble a plaited basket. | FIG. 9(b) |
| Leno | A weave in which the warp yarns are arranged in pairs with one twisted around the other between picks of filling yarn as in marquisette. This type of weave gives firmness and strength to an open-weave fabric and prevents slippage and displacement of warp and filling yarns. | FIG. 9(c) |
| Huckaback | Huckaback is a combination of plain and floated weaves. It gives an absorbent fabric because of the floated weave and a firm structure due to the presence of the plain weave. | FIG. 9(d) |
| Honeycomb | A fabric in which the warp and weft threads float to form a honeycomb shape with ridges and hollows to produce a cellular cloth. | FIG. 9(e) |

WORKING EXAMPLE

Using polyester warp and various types of weft yarns (viz. cotton, Coolmax, Thermolite), four two-layer fabrics and fifteen three-layer fabrics were produced. Detailed parameters of the fabrics are shown in Table-1. Detailed results of the MMT test for all the fabrics are shown in the Table-2.

TABLE 1

Particulars of Different Fabric Samples

| S. no. | Fabric Design and construction | Warp Yarn | Weft Yarn | Weight kg/mt$^{-2}$ | Thickness ($\times 10^{-3}$ mt) | EPcm | PPcm |
|---|---|---|---|---|---|---|---|
| | Two Layer Structure | | | | | | |
| 1 | Plant structure(F-Plain, B-2/2 Matt) | 11.11 Tex polyester | 7.38 Tex 100% Cotton | 168.7 | 0.562 | 64 | 86 |
| 2 | Two layer interchanged plain | 11.11 Tex polyester | 7.38 Tex Cotton Yarn | 157.7 | 0.568 | 64 | 85 |
| 3 | Plant structure(F-Plain, B-2/2 Matt) | 11.11 Tex polyester | 19.76tex/100% coolmax | 226.5 | 0.669 | 65 | 64 |
| 4 | Two layer interchanged plain | 11.11 Tex polyester | 19.76tex/100% coolmax | 225.6 | 0.701 | 65 | 65 |

TABLE 1-continued

| Particulars of Different Fabric Samples | | | | | | | |
|---|---|---|---|---|---|---|---|
| S. no. | Fabric Design and construction | Warp Yarn | Weft Yarn | Weight kg/mt$^{-2}$ | Thickness ($\times 10^{-3}$ mt) | EPcm | PPcm |
| | Three Layer Structure | | | | | | |
| 1 | Plant structure (F-Plain, M-2/2 Matt, B-4/4 Matt) | 11.11 Tex polyester | 28 tex/2 100% cotton | 348.08 | 1.81 | 62 | 63 |
| 2 | Three layer interchanged plain | 11.11 Tex polyester | 28tex/2 100% cotton | 341.46 | 1.67 | 59 | 61 |
| 3 | Three layer interchanged Matt | 11.11 Tex polyester | 28tex/2 100% cotton | 356.18 | 1.84 | 63 | 66 |
| 4 | Three layer Plain Matt Matt(tree) | 11.11 Tex polyester | 28tex/2 100% cotton | 349.48 | 1.79 | 61 | 64 |
| 5 | Three layer Plain | 11.11 Tex polyester | 28tex/2 100% cotton | 321.78 | 1.48 | 58 | 54 |
| 6 | Plant structure (F-Plain, M-2/2 Matt, B-4/4 Matt) | 11.11 Tex polyester | 37.96tex/2 Thermolite | 359.47 | 1.49 | 65 | 63 |
| 7 | Three layer interchanged plain | 11.11 Tex polyester | 37.96tex/2 Thermolite | 340.57 | 1.29 | 63 | 61 |
| 8 | Three layer interchanged Matt | 11.11 Tex polyester | 37.96tex/2 Thermolite | 375.98 | 1.59 | 65 | 68 |
| 9 | Three layer Plain Matt Matt(tree) | 11.11 Tex polyester | 37.96tex/2 Thermolite | 360.17 | 1.63 | 65 | 61 |
| 10 | Three layer Plain | 11.11 Tex polyester | 37.96tex/2 Thermolite | 329.06 | 1.09 | 59 | 55 |
| 11 | Plant structure (F-Plain, M-2/2 Matt, B-4/4 Matt) | 11.11 Tex polyester | 39.52tex/2 100% coolmax | 368.03 | 1.79 | 64 | 65 |
| 12 | Three layer interchanged plain | 11.11 Tex polyester | 39.52tex/2 100% coolmax | 360.04 | 1.21 | 63 | 61 |
| 13 | Three layer interchanged Matt | 11.11 Tex polyester | 39.52tex/2 100% coolmax | 376.14 | 1.88 | 64 | 66 |
| 14 | Three layer Plain Matt Matt(tree) | 11.11 Tex polyester | 39.52tex/2 100% coolmax | 366.97 | 1.85 | 65 | 61 |
| 15 | Three layer Plain | 11.11 Tex polyester | 39.52tex/2 100% coolmax | 323.60 | 1.11 | 57 | 53 |

F—Face,
M—Middle,
B—Back.

TABLE 2

| MMT Test results of different 3-layers fabric samples | | | | | | | | | |
|---|---|---|---|---|---|---|---|---|---|
| Sample | Welling Time | | Abs rate % | | Max wet Radius | | Spreading speed | | One way |
| No. | inside | outside | Inside | Outside | Inside | Outside | inside | outside | transport |
| Two Layer Fabric | | | | | | | | | |
| Cotton | | | | | | | | | |
| 1 | 2.12 | 2.19 | 58.24 | 62.94 | 30 | 30 | 2.53 | 2.64 | 148.85 |
| 2 | 2.1 | 2.1 | 69.6 | 68.0 | 30.0 | 30.0 | 2.5 | 2.5 | 44.9 |
| Coolmax | | | | | | | | | |
| 3 | 2.2 | 2.2 | 44.3 | 55.3 | 23.0 | 26.0 | 2.1 | 2.2 | 272.9 |
| 4 | 2.2 | 2.3 | 42.6 | 51.8 | 30.0 | 30.0 | 2.1 | 2.1 | 129.7 |
| Three Layer Fabric | | | | | | | | | |
| Cotton | | | | | | | | | |
| 1 | 2.75 | 2.88 | 43.65 | 45.46 | 21.00 | 27.00 | 1.60 | 1.66 | 186.48 |
| 2 | 2.83 | 2.88 | 43.17 | 45.32 | 25.00 | 25.00 | 1.35 | 1.33 | 141.15 |
| 3 | 2.75 | 2.91 | 43.57 | 45.33 | 20.00 | 20.00 | 1.13 | 1.11 | 93.49 |
| 4 | 2.86 | 2.93 | 46.43 | 46.02 | 20.00 | 25.00 | 1.22 | 1.30 | 165.58 |
| 5 | 3.19 | 3.14 | 43.46 | 45.37 | 27.00 | 26.00 | 1.53 | 1.50 | 160.30 |
| Thermolite | | | | | | | | | |
| 6 | 2.69 | 2.63 | 39.74 | 54.26 | 21.00 | 27.00 | 1.55 | 1.79 | 276.39 |
| 7 | 3.03 | 3.03 | 43.57 | 51.43 | 24.00 | 26.00 | 1.49 | 1.51 | 210.77 |
| 8 | 3.56 | 3.41 | 39.02 | 50.16 | 24.00 | 27.00 | 1.44 | 1.47 | 205.09 |
| 9 | 2.84 | 2.91 | 43.17 | 50.60 | 22.00 | 25.00 | 1.47 | 1.49 | 272.53 |
| 10 | 2.90 | 2.96 | 55.77 | 58.26 | 24.00 | 25.00 | 1.55 | 1.46 | 171.43 |
| Coolmax | | | | | | | | | |
| 11 | 2.53 | 2.68 | 57.67 | 62.91 | 26.00 | 30.00 | 1.97 | 2.00 | 230.13 |
| 12 | 2.72 | 2.72 | 69.35 | 59.32 | 22.00 | 25.00 | 1.41 | 1.45 | 198.60 |
| 13 | 2.97 | 2.74 | 42.64 | 58.80 | 20.00 | 20.00 | 1.30 | 1.23 | 155.28 |
| 14 | 2.55 | 2.98 | 62.32 | 58.04 | 23.00 | 25.00 | 1.34 | 1.27 | 200.05 |
| 15 | 3.07 | 3.20 | 52.66 | 56.54 | 24.00 | 21.00 | 1.27 | 1.23 | 170.16 |

From Table 2, we can also see that the two-layer fabrics and three-layer fabrics have much better (up to 3 times) one way water transport properties than fabrics of other structures in similar weights. The faster initial water absorption and much improved one way water transport properties of the plant structured fabrics are very advantageous to thermal comfort in terms of keeping the wearer dry and cool when sweating.

Figure 7A:
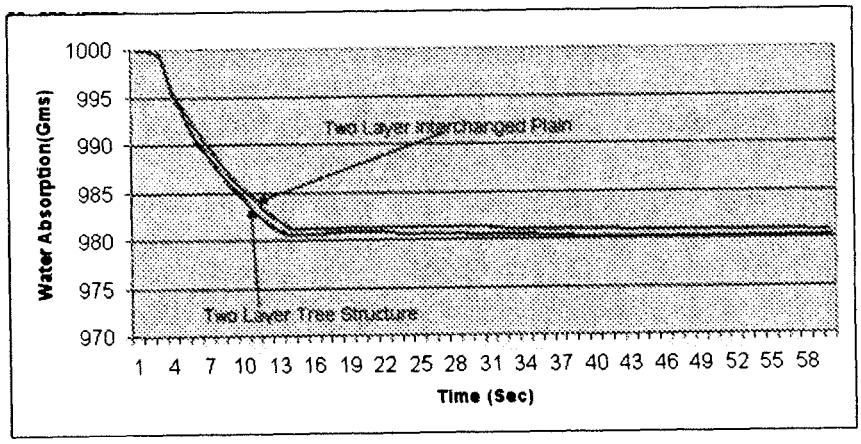
FIG. 7(*a*) is a graph showing the absorption behavior of the fabric having two-layer Plant Structure (Cotton Weft)
Figure 7B:
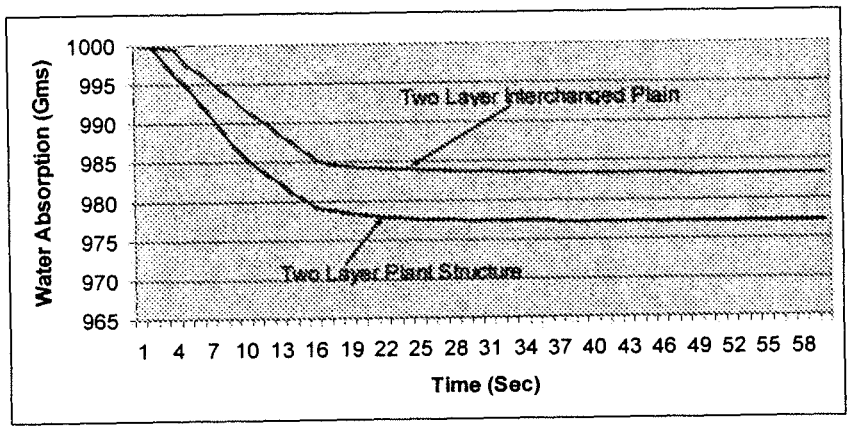
Figure 8:
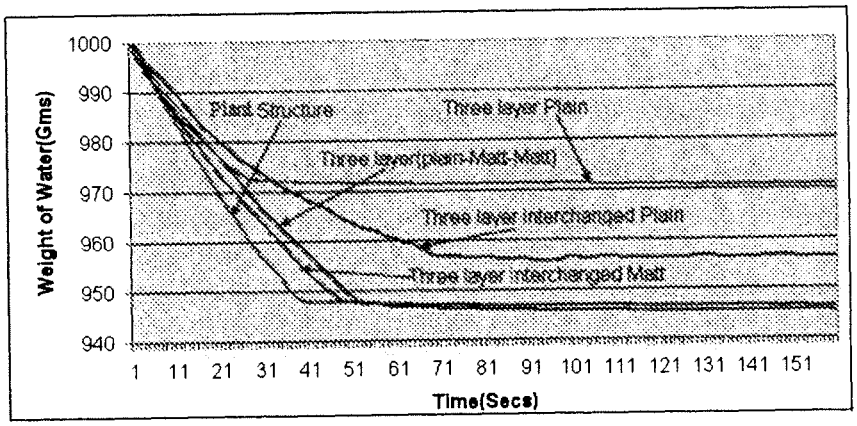
FIG. 8 is a graph showing the absorption behavior of the fabric having the three-layer Plant Structure.

All fabrics were tested using a Transplanar Water Transport Tester (TWTT) (Patent pending) and Moisture Management tester (MMT). During the testing by TWTT, the fabric specimen was in contact with a water surface of constant water level. The amount of water absorbed or transmitted through the fabric was measured in real time. Results are illustrated in FIG. 7(*a*&*b*) and FIG. 8. As it can been seen from FIG. 7(*a*), 7(*b*) and 8, the plant structured two-layer and three-layer fabrics have significantly faster initial water absorption rate and total water absorption than fabrics of other constructions made of the same types of yarns and in similar weight, respectively.

What is claimed is:

1. A fabric having moisture management function, wherein the fabric has a structure simulating a branching structure of a plant and comprises at least two layers as follows:

a bottom layer in which a number of yarns are grouped together to form a plurality of fabric units so as to form a structure simulating a main stem of the plant; and a top layer in which the yarns of said fabric units from the bottom layer split in the top layer by a branching so as to form the structure simulating the branching structure of the plant, wherein, in said fabric, water is transported from the bottom layer to the top layer due to the branching of the yarns and evaporates such that moisture management function is provided.

2. The fabric having moisture management function according to claim 1, wherein said fabric further comprises a middle layer in which the yarns of said fabric units in the bottom layer split initially in the middle layer, which splits further in the top layer so as to form the structure simulating the branching structure of the plant, wherein, in said fabric, water is transported from the bottom layer to the middle layer and further to the top layer by the branching of the yarns and evaporates such that moisture management function is provided.

3. The fabric having moisture management function according to claim 1, wherein said structure simulating the branching structure of the plant is a woven structure.

4. The fabric having moisture management function according to claim 1, wherein said structure simulating the branching structure of the plant is a knitted structure.

5. The fabric having moisture management function according to claim 1, wherein said bottom layer comprises a leno structure.

6. The fabric having moisture management function according to claim 1, wherein said bottom layer comprises a matt structure.

7. The fabric having moisture management function according to claim 1, wherein said top layer comprises a plain weave structure.

8. The fabric having moisture management function according to claim 2, wherein the middle layer comprises a hopsack structure.

9. The fabric having moisture management function according to claim 2, wherein the middle layer comprises a huckaback structure.

10. The fabric having moisture management function according to claim 2, wherein the middle layer comprises a honeycomb structure.

11. The fabric having moisture management function according to claim 1, wherein said top layer is further finished to create hairiness and/or loops to further simulate leaves of the plant so as to provide water transport effect.

12. The fabric having moisture management function according to claim 1, wherein said bottom layer is further finished to brush pile to simulate roots of the plant so as to absorb water effectively.

13. The fabric having moisture management function according to claim 1, wherein hydrophilic treatment is applied to the bottom layer so as to enhance water absorption capacity.

14. The fabric having moisture management function according to claim 13, wherein said hydrophilic treatment includes oxygen plasma and oxidation treatment.

15. The fabric having moisture management function according to claim 1, wherein the bottom layer is adapted to be in contact with human skin.

16. An article comprising:

at least two layers, wherein one layer of the at least two layers is a bottom layer in which a number of yarns are grouped together to form a plurality of fabric units so as to form a structure simulating a main stem of a plant, wherein another layer of the at least two layers is a top layer in which the yarns of said fabric units from the bottom layer split in the top layer by a branching so as to form a structure simulating a branching structure of the plant, and wherein, in said article, water is transported from the bottom layer to the top layer due to the branching of the yarns and evaporates such that moisture management function is provided.

17. An article comprising:

at least three layers, wherein one layer of the at least three layers is a bottom layer in which a number of yarns are grouped together to form a plurality of fabric units so as to form a structure simulating a main stem of a plant, wherein another layer of the at least three layers is a middle layer in which the yarns of said fabric units in the bottom layer split initially in the middle layer by a branching so as to form a structure simulating a first branching structure of the plant, wherein a further layer of the at least three layers is a top layer in which the yarns of said fabric units in the middle layer further split in the top layer by a branching so as to form a second structure simulating a second branching structure of the plant, and wherein, in said article, water is transported from the bottom layer to the middle layer and further to the top layer due to the branching of the yarns and evaporates such that moisture management function is provided.

18. The article according to claim 16, wherein the article is a carpet, a manmade grass, or a geotextile.

19. The article according to claim 17, wherein the article is a carpet, a manmade grass, or a geotextile.

* * * * *